US007708043B2

(12) United States Patent
Pasqualoni

(10) Patent No.: US 7,708,043 B2
(45) Date of Patent: May 4, 2010

(54) DEVICE FOR SPLICING WEB MATERIAL

(75) Inventor: Paolo Pasqualoni, Sambuceto di San Giovanni Teatino (IT)

(73) Assignee: Fameccanica.Data S.p.A., Sambuceto di San Giovanni Teatino (Chieti) (IT)

( * ) Notice: Subject to any disclaimer, the term of this patent is extended or adjusted under 35 U.S.C. 154(b) by 768 days.

(21) Appl. No.: 11/562,146

(22) Filed: Nov. 21, 2006

(65) Prior Publication Data

US 2007/0113984 A1 May 24, 2007

(30) Foreign Application Priority Data

Nov. 21, 2005 (IT) ..... TO2005A0823

(51) Int. Cl.
*B65H 21/00* (2006.01)

(52) U.S. Cl. ..... 156/502; 156/157; 156/159; 156/504; 156/505; 269/59; 269/74

(58) Field of Classification Search ..... 156/157, 156/159, 502, 504, 505; 269/59, 72, 74
See application file for complete search history.

(56) References Cited

U.S. PATENT DOCUMENTS 4,157,934 A 6/1979 Ryan et al.
4,995,937 A * 2/1991 Persson ..... 156/543
5,468,321 A * 11/1995 van Liempt et al. ..... 156/159
6,451,145 B1 * 9/2002 Forbes ..... 156/159
2004/0084133 A1 * 5/2004 Adami ..... 156/159

* cited by examiner

*Primary Examiner*—Mark A Osele
(74) *Attorney, Agent, or Firm*—Heslin Rothenberg Farley & Mesiti P.C.; Victor A. Cardona, Esq.

(57) ABSTRACT

A device for splicing the free end of a strip of web material to a homologous strip of web material being supplied includes a first moving element and a second moving element, each of which is able to function alternatively as retention structure for the free end and as guiding structure for the web. The moving elements are, at least in part, translatable with respect to one another for connecting the free end to the web, performing the operation of splicing. The first and the second moving elements are selectively orientable between a position of opening, in which the moving element has a gripping formation exposed to receive the free end, and a position of closing, in which the gripping formation faces the other moving element of the device to allow the free end to connect to the web.

13 Claims, 4 Drawing Sheets

DEVICE FOR SPLICING WEB MATERIAL

CROSS-REFERENCE TO RELATED APPLICATIONS

This application claims priority from Italian Patent Application No. TO2005A000823 filed on Nov. 21, 2005, the entire disclosure of which is incorporated herein by reference.

FIELD OF THE INVENTION

The present invention relates to devices for splicing web material. The invention has been developed with particular attention paid to its possible use in the field of plants for the production of hygienic-sanitary products.

BACKGROUND OF THE INVENTION

In the sector of hygienic-sanitary products (and also in other sectors of the art, such as, for example, the automatic-packaging sector) there commonly find application unwinding devices for supplying web material, equipped with splicing systems (the so-called "splicers"), which enable joining to a web being supplied from a reel that is running out one end of a web of a new reel. The connection is usually made adhesively (for example, with a bi-adhesive tape), and the operation of splicing is performed by cutting the old web immediately after the join so as to reduce to a minimum the length of the "trailing end" that the old web draws along with it (or "overlap"). The operation is performed without stopping the movement of supply of the web: the stations that use the web consequently see the unwinder as a source that supplies a web of virtually infinite length without any interruption.

A splicing device of the type specified above is described in the document U.S. Pat. No. 4,157,934, which is used as model for the preamble of Claim 1.

Albeit having encountered a considerable success over the years, this solution is not free from drawbacks in use.

The corresponding device is, in fact, built as a structure that is as a whole closed both on account of problems of safety and on account of problems of the manufacturing process. In particular, the aim is to provide a structure that is very rigid, in which the distances between the blades and the counter-blade that are to make the cut in the web, as well as the distances between the two pressure pads (50, according to the numbering adopted in FIG. 1 of the document U.S. Pat. No. 4,157,934), are reduced. This is done for various reasons, not the least of which is to reduce the time necessary for completing the splicing operation.

In the step of pre-arrangement of the device for carrying out the splicing operation, the operator is thus forced to work in particularly critical conditions. The unwinding devices—and hence the splicing devices associated thereto—are usually mounted in the top part of the machines so as to cause the web supplied thereby to drop down from above. This arrangement is convenient for reasons of encumbrance and because it prevents the unwinder from interfering with the other parts of the machine.

However, to be able to pre-arrange the device for carrying out a new splicing operation, the operator responsible finds himself having to perform a sequence of extremely inconvenient operations.

Usually, after mounting the "new" reel in the unwinder (an operation that is usually performed from the ground with a small crane or hoist), the operator climbs to the top of a ladder in order to bring himself to the same height as the unwinder and, whilst he is at the top of the ladder, leaning forwards to reach over the structures for covering and protecting the machine, he must:

release from the "new" reel the free end that is to be used for the splicing operation;

apply on this free end (the material being usually quite soft—for example, having the consistency of toilet paper or even less) a bi-adhesive tape for a length of 300-400 mm;

insert edgeways the end of the web thus adhesivized in the top slit of the splicing device, getting it to drop until it is brought down in front of the compliant contrast element that is to press the aforesaid free end against the web of the "old" reel;

ensure (operating in conditions of purely visual control—for example observing the descent of the free adhesivized end of the web through a slit of Plexiglas) the exact lateral alignment of the end of the web with the web being unwound; and finally, block the aforesaid free end of web in the desired position to be able to perform the splicing operation.

The latter operation is particularly inconvenient and difficult because, to be able to activate the corresponding gripping device, the operator must free one of his hands engaged in the operation of insertion and alignment of the web.

The entire operation is further complicated by the fact that, whilst the device is prepared for performing the splicing operation, the machine in which the unwinding device is included continues to function. This means that the operator encounters, at a short distance from the splicing device, the "working" web, which continues to be supplied—even at a rather fast rate—by the unwinding device. In addition, he must prevent any contact with said working web, seeing that even a short and slight contact could result, on account of the fragility of the material, in an undesired tearing of the web with the consequent need to stop the machine and the corresponding work cycle.

OBJECT AND SUMMARY OF THE PRESENT INVENTION

The object of the present invention is to provide a splicing device, which, while maintaining the unquestionable operating advantages linked to the adoption of the solution according to the known art described previously, prevents the drawbacks outlined above from arising.

According to the present invention, this object is achieved thanks to a device having the characteristics referred to specifically in the ensuing claims.

The claims form an integral part of the technical teaching provided herein regarding the invention.

BRIEF DESCRIPTION OF THE DRAWINGS

The invention will now be described, purely by way of non-limiting example, with reference to the annexed figures of drawing, in which.

Figure 1:
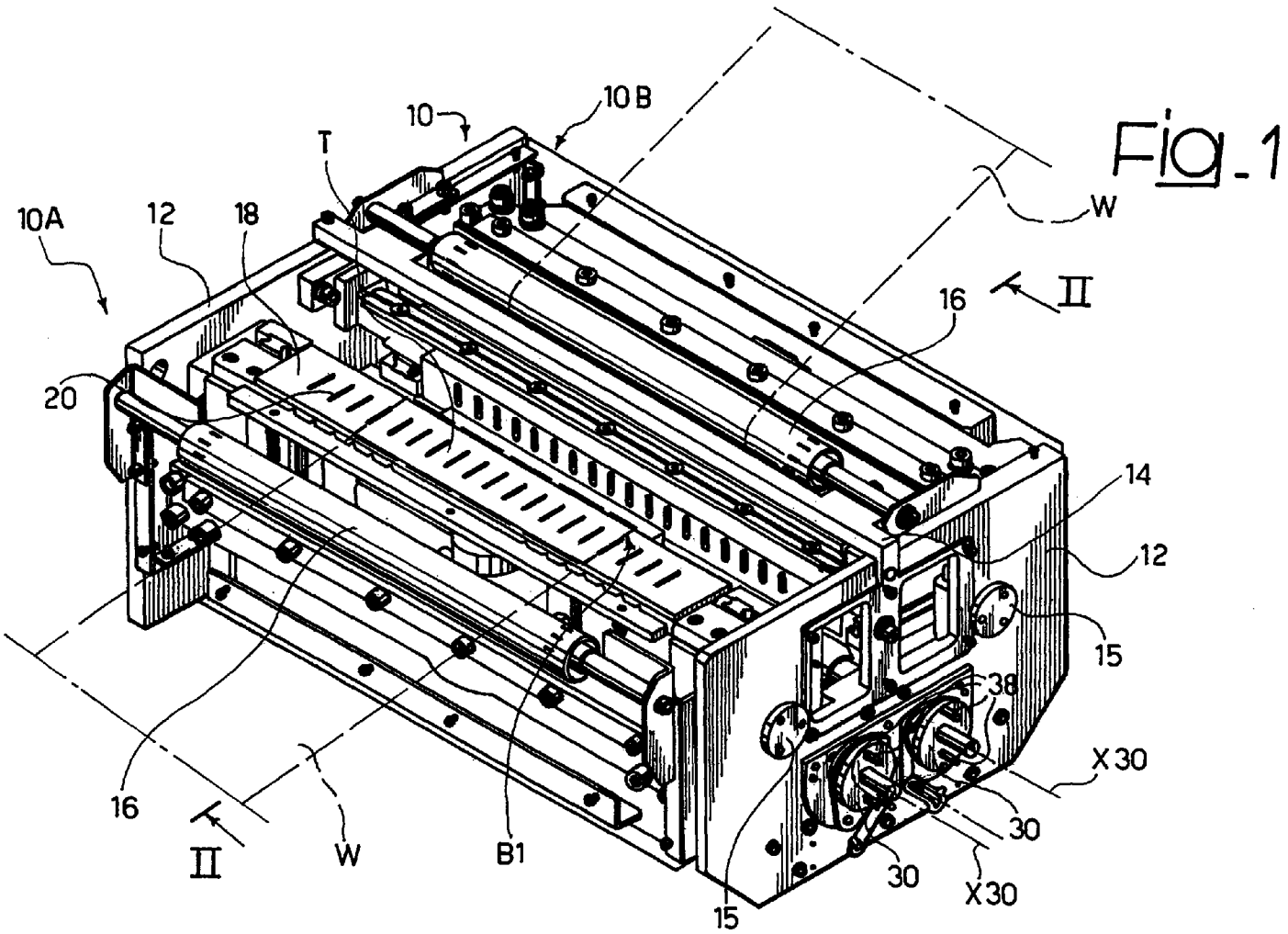
FIG. 1 is a general perspective view of a device according to the invention viewed in the condition in which the device itself is in the course of pre-arrangement for performing the splicing function.
Figure 2:
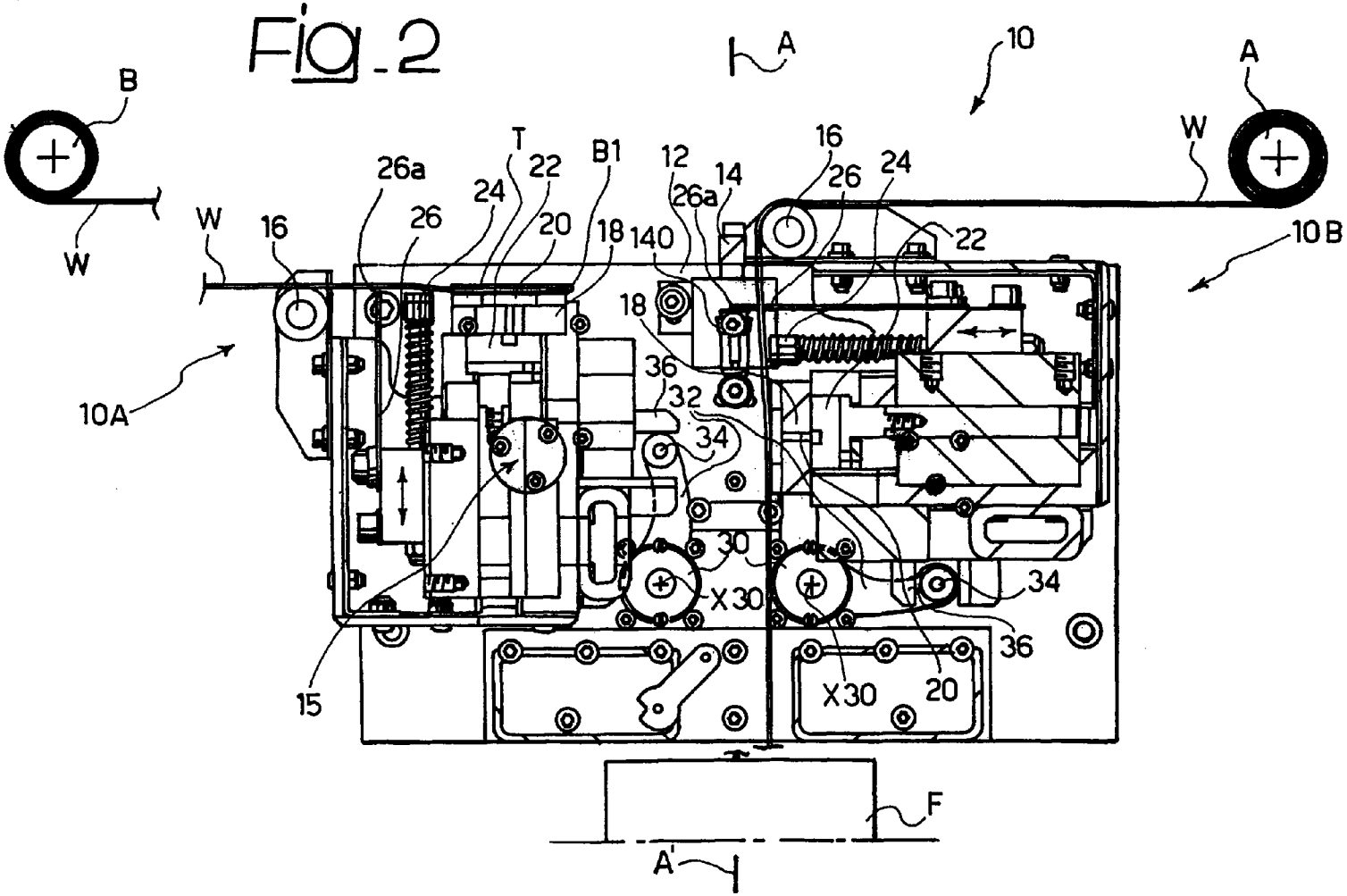
FIGS. 2 to 4 are three vertical median cross-sectional views substantially corresponding to the plane of cross section identified by the line II-II of FIG. 1.
Figure 3:
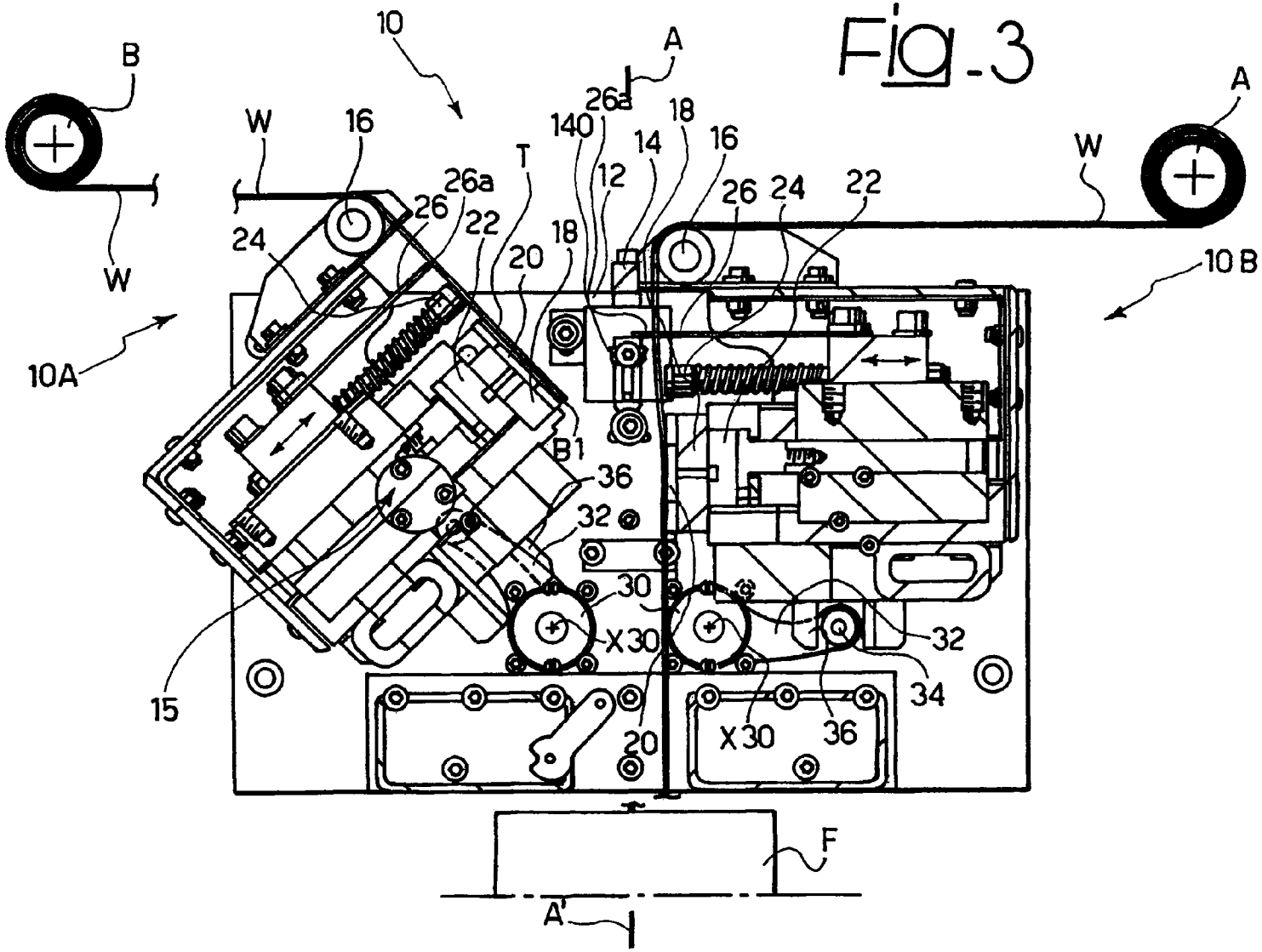
Figure 4:
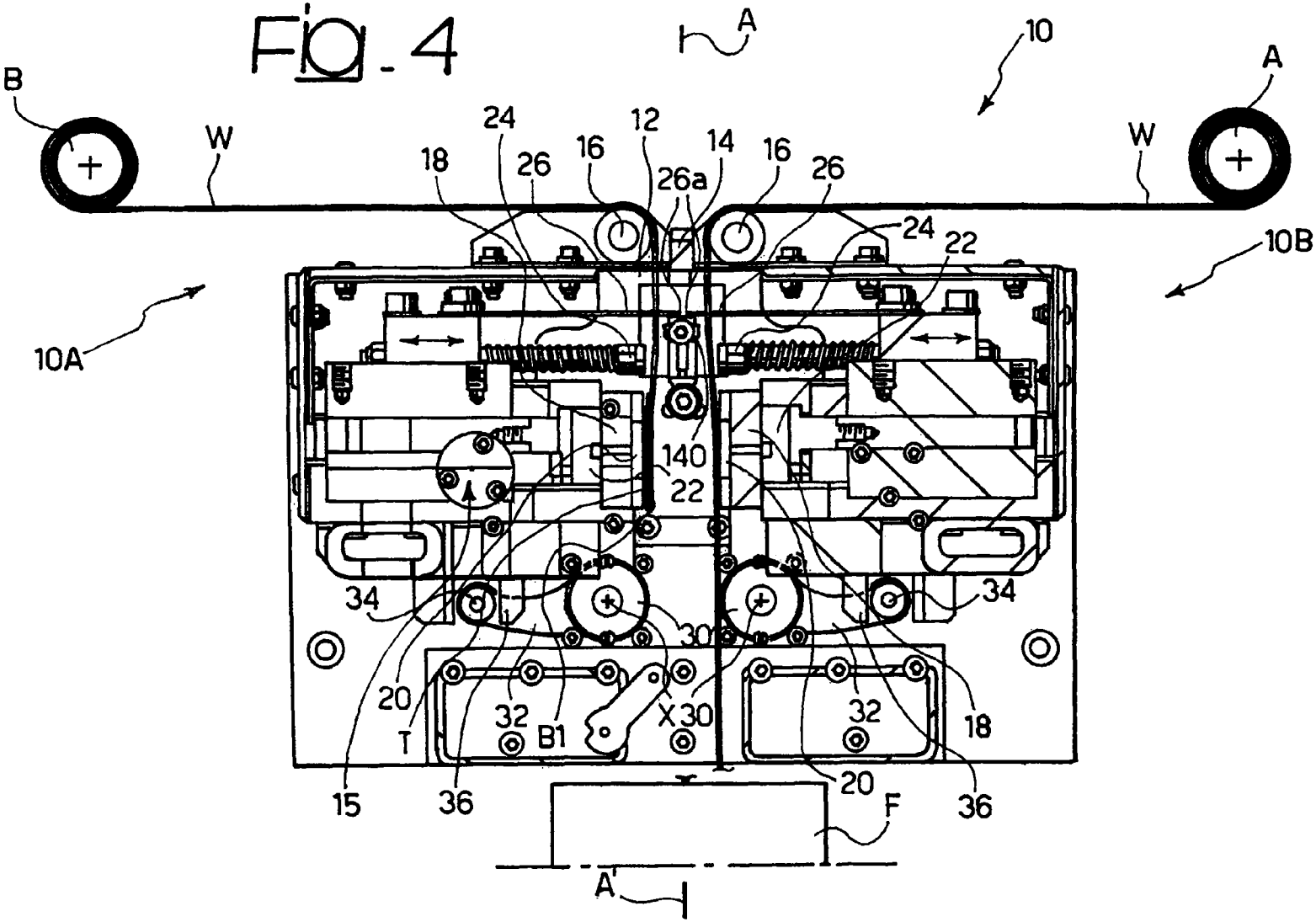

In particular, the cross section of FIG. 2 corresponds exactly to the condition represented in FIG. 1, where the device is pre-arranged for performing the splicing function, whilst the sections of FIGS. 3 and 4 correspond, respectively, to the closing movement that brings the device into the condition of performing the splicing operation and causes said operating position to be actually reached.

DETAILED DESCRIPTION OF THE INVENTION

The device according to the invention, designated as a whole by 10, is designed to operate in the framework of an unwinding device for supplying a web material to a machine that uses it—not illustrated—constituted typically by one of the workstations of a plant for the production of hygienic-sanitary products. In this connection, it should once again be recalled that, even though the invention has been developed with particular attention paid to this possible field of application, the scope of the invention itself is not in itself limited to this context.

Specifically, the device 10 is to interact with two reels A and B from which the aforesaid web material, designated as a whole by W, is unwound.

In the sequel of the present description, it will ideally be assumed that the reel A is a reel that is currently supplying web material to the station that uses it, and is consequently bound to run out as a result of the gradual supply of the aforesaid material.

The reel B is instead a "new" reel provided with a free end B1 that is to be connected adhesively to the web supplied by the reel A when the latter approaches the condition where it has completely run out, in such a way as to cause the reel B to take the place of the reel A during supply of the material W.

The device 10 is to be set upstream of a so-called "festoon" F, basically constituted by an array of rollers on which the material W that is being supplied is wound according to a general zigzag path, the aim being to form an accumulation or store of material W that enables continuity of supply of the material W to the station that uses it at a constant rate (generally high) whilst the sections of material W located upstream of the festoon F are slowed down (virtually stopped, at least momentarily) for carrying out the operation of splicing of the free end B1 of the "new" reel B to the trailing stretch of the "old" reel A.

In the condition illustrated in the figures of the annexed plate of drawings, the reel A is the "old" reel, whilst the reel B is the "new" reel. Of course, at the subsequent splicing operation, the reel B will be the "old" reel, whilst the reel A will be the "new" reel.

The device 10 must hence be able to allow replacement of an "old" reel with a "new" reel in a situation in which, in the sequence of the operation of splicing, the aforesaid reels are located alternately on one and on the other side of the device 10. For this reason, the device 10 has a general specular symmetry about a central median axis, designated by A-A' in FIGS. 2 to 4.

The device 10 then comprises, as active elements, two moving elements 10A, 10B, substantially symmetrical with respect to the plane A-A'.

As has already been said in the introductory part of the present description, the general criteria of operation of the device 10 are to be deemed substantially similar to those of the device described in the document U.S. Pat. No. 4,157,934. The general criteria of operation of such a device are hence to be deemed known, and consequently such as not to require any detailed description herein.

In particular, the ensuing description aims at describing the structure of operation of the device 10, with specific reference to achieving pre-arrangement for the operation of splicing/reel change illustrated in FIG. 4. Starting from this position, the action of splicing and cutting of the trailing end of the "old" reel (in the present case, the reel A) is performed according to modalities substantially similar to the ones illustrated in the document U.S. Pat. No. 4,157,934 and will consequently not be illustrated in detail herein.

In general, the device 10 comprises a supporting structure with a robust frame 11, comprising a pair of side plates 12 connected by one or more cross members 14 and with an as a whole hollow central portion that defines what can be approximately defined as a sort of central slit, through which the web material W coming from the reels A and B can be made to pass and drop downwards in the direction of the festoon F.

One of the aforesaid cross members carries at the top an insert made of hard metal, designated by 140, having a cross section shaped like an isosceles trapezium, with the major base facing upwards. As will be explained in greater detail in what follows, the insert 140 is to function as counterblade in the operation of cutting of the "trailing end" of the web of the old reel (in the case illustrated here, the reel A).

Between the two plates 12 there likewise extend (in positions roughly specular with respect to the central median plane A-A', as the vast majority of the elements described in what follows), two shafts or pins 15, mounted about which so that they can turn are the two moving elements 10A and 10B that carry the active elements of the device 10.

In particular, each of the moving elements 10A, 10B carries a respective roller 16, which is situated in general in the top part of the device 10 and is to function as entraining roller for the material W that is wound off the reel A or B.

In a position roughly opposite to the roller 16, each moving element 10A, 10B then carries a bar 18, which extends through the structure of the device 10 (see in particular the perspective view of FIG. 1) and has a general openworked structure, being provided with openings constituted, for example, by an array of slits designated by 20 (see once again the perspective view of FIG. 1).

Each bar 18 is to function as contrast formation capable of withholding on itself the free end B1 of the "new" reel that is pre-arranged for performing the operation of splicing and reel change.

For this purpose, provided underneath the bar 18 is a chamber 20, which usually has an elongated shape and is possibly split up into a number of compartments, roughly co-extensive with the bar 18. The chamber 20 comes under a pneumatic line—not explicitly visible in the drawings, but of a known type—, which enables selective creation within the chamber 22 of a level of subatmospheric pressure, i.e., a level of "vacuum".

In this way, the free end B1 of the "new" reel B can be applied on the device 10 and withheld in a precise position, whilst a length of bi-adhesive tape T, which is to enable splicing to the web being wound off the "old" reel A, is applied on said free end B1, or—in any case (i.e., even when the length of web T has already been applied previously)—whilst the operator removes the strip of anti-adherent material (siliconized paper) set for protection of the face of the bi-adhesive length opposite to the web W.

Provided in a position roughly set between the roller 16 and the bar 18 is a compliant contrast element 24 (for example, with spring loading), which is to keep gripped against the cross member that carries the counterblade 140 the trailing end of the web of the "new" reel whilst the latter is prepared and is awaiting reel change.

Located above the compliant contrast element 24—i.e., in an intermediate position between the compliant contrast element 24 and the roller 16—is then a blade 26, which is to carry out (according to the same modalities as those described in U.S. Pat. No. 4,157,934) the function of cutting the "trailing end" of the old reel on which splicing of the free end of the "new" reel has just been performed.

According to a preferential characteristic of the solution illustrated herein, each of the blades 26 has a trapezoidal shape, in the sense that its front cutting edge 26*a* does not run parallel to the counterblade 140 but, instead, has a rectilinear conformation inclined at least by a small fraction of degree with respect to the counterblade 140, with the cutting edge constantly interfering with the counterblade 140. This angled conformation of the cutting edge 26*a* of the blades 26 means that the movement of gripping between each blade 26 and the respective side of the counterblade 140 performs, on the trailing end of the web of the "old" reel, a shearing action that starts on one side of the web and then runs transversely through the web that is being cut.

This cutting modality, and in particular the presence of the counterblade 140, is especially advantageous when it is necessary to operate on very fibrous materials, such as non-woven fabrics or absorbent materials (e.g., the so-called "acquisition layers").

The relative arrangement of the parts illustrated in the drawings corresponds, on the other hand, to a preferred embodiment of the solution described herein. Persons skilled in the sector will, however, readily appreciate that this arrangement, albeit preferred, is in no way imperative in the sense that, for example (and it is emphasized that this is just one example of different possible variants) the blade 26 could find itself in a position set between the compliant contrast element 24 and the plate 18.

An important characteristic of the solution described herein lies in the fact that the two moving elements 10A, 10B are not mounted in a position fixed with respect to the frame of the device 10 but are instead each able to be selectively oriented between a position of "closing" and a position of opening, which is to be used for pre-arranging either one or the other moving element for performing the operation of splicing.

For immediate reference:

in the perspective view of FIG. 1, the moving element 10A (in the foreground) is in a position of opening, whilst the moving element 10B (in the background) is in a position of closing, a similar arrangement being reproduced in the cross-sectional view of FIG. 2;

FIG. 3 illustrates the gradual movement of turning-over of the moving element 10A from the position of opening to the position of closing, i.e., the position in which the moving element 10B is found; and in the cross-sectional view of FIG. 4 both of the moving elements 10A, 10B are in the closing position.

In the condition of normal operation of the device, i.e., whilst the material W is supplied towards the festoon F from a reel (assume, for example, the reel A, with reference to the situation illustrated in the drawings), with said reel still far from the condition where it is about to run out, the device 10 is kept in a closing condition.

When the condition where the reel that is currently supplying the web W runs out is approached (a condition that can be detected by an operator responsible for control, or else that is signalled automatically by a sensor—of a known type—for detecting that the reel has run out), the operator intervenes on the device 10 bringing the moving element to which the "new" reel is associated (in the case in point, the reel B) into the opening position, represented in FIGS. 1 and 2.

At this point, the operator can proceed to picking up the free end B1 of the "new" reel, setting it up against the bar 18 of the moving element brought into an opening position, in which (as a result of a positive command issued by the operator or else as a result of a command generated automatically—according to known criteria—following upon the movement of opening of the rotary element) the "vacuum" line that creates the subatmospheric pressure within the chamber 22 has been activated.

At this point, through the openings 20 of the bar 18 a suction mechanism is provided, which enables precise positioning of the free end B1 on the bar 18 with the consequent possibility, by the operator, of releasing the aforesaid free end, so freeing both of his hands. The aforesaid free end B1 is kept on the moving element 10A by the action of the vacuum (subatmospheric pressure) generated underneath the bar 18.

At this point, the operator is free to proceed to a series of operations.

Said operations can comprise, for example, positioning of the length of bi-adhesive tape T on the free end B1 of the web of the new reel.

This operation may, on the other hand, already have been performed previously by the operator by applying the length T of bi-adhesive tape on the free end of the reel B at the moment when this was taken up and moved away from the outer surface of the reel B.

In any case, after setting the free end B1 of the reel B on the bar 18, the operator can remove the strip of anti-adhesive material (typically siliconized paper) that normally protects the surface of the length T opposite to the surface that has been made to adhere to the free end B1 of the web of the reel B.

In this connection, the aforesaid protective strip usually constitutes a sufficiently rigid element that facilitates the operations of positioning and centring of the web of the "new" reel: it is in fact evident that it would be desirable to connect the web of the "new" reel to the web of the "old" reel in a centred position, i.e., without giving rise to lateral displacements of the web.

It will likewise be appreciated that the solution described herein is conveniently usable also for materials W having characteristics of permeability to air (for example, perforated topsheets, or webs of non-woven fabric with a particularly sparse mesh), in regard to which an action of vacuum or suction pressure could prove insufficiently effective and reliable. The length of bi-adhesive tape T is in fact able to render the free end of the web B sufficiently compact and impermeable to air to enable a firm action of gripping by vacuum or negative-pressure.

Once the free end B1 of the web of the new reel has been properly positioned, the operator brings the moving element on which he has intervened (the moving element 10A, in the example illustrated herein) back into position, turning it about the respective shaft 15 until it is brought back into the closing condition.

As has already been said, the cross-sectional view of FIG. 3 illustrates an intermediate step of the aforesaid movement of turning-over about the shaft 15 (which may be of the fixed type or else be free to turn according to different design choices) until the closing position represented in FIG. 4 is reached. Usually, when said closing position is reached, this is accompanied by deactivation (preferably controlled automatically) of the line of the vacuum that applies subatmospheric pressure to the chamber 22 of the gripping bar 18. In said conditions, in fact, the free end B1 is withheld within the device by the mechanical-gripping system, i.e., by the compliant contrast element 24 that grips the web against the plate 18, thus withholding the aforesaid free end in position.

This process continues up to the moment when (according to the modalities that can be inferred from the document U.S. Pat. No. 4,157,934) the moving element up against which the web of the "old" reel (in the present case the moving element 10B) is currently being unwound advances towards the other moving element (in the present case, the moving element 10B) on which the free end B1 of the "new" reel is positioned.

The aforesaid movement of advance (which takes place on guide formations and is controlled by pneumatic cylinders, according to criteria in themselves known) brings the web of the "old" reel up against the length of bi-adhesive tape T set on the free end B1 of the "new" reel.

In this way, the free end B1 of the "new" reel is spliced to the web of the "old" reel and is thus drawn towards the festoon F, which in the meantime has been activated so as to decrease (and virtually nullify) the rate of advance of the stretch of web from the device 10 in such a way that the operation of splicing can be carried out without applying appreciable stresses on the web itself.

At the same time, the movement of advance of the moving element 10B causes the respective blade 26 to advance with respect to the counterblade 140 and to cut (with the shearing action described previously) the web of the "old" reel: the cut is made in a stretch of the web of the old reel which—in the direction of advance —is located immediately after the stretch that has been made to adhere against the length of web T carried by the "new" reel.

The web of the "old" reel is thus isolated with respect to the web (now supplied by the "new" reel) that drops towards the festoon F, leaving as residue just a short "trailing end", which can possibly be discarded at the level of subsequent treatment operations. The "old" reel, which has run out, can thus be removed from the unwinder, to be replaced by a full reel that is to constitute the "new" reel in a subsequent operation of splicing and reel change. The device 10 will be pre-arranged for carrying out this subsequent operation by acting on the moving element 10A, which will be opened and then reclosed by performing a sequence of operations altogether similar to the one described previously, with the roles of the reels A and B and, respectively, of the moving elements 10A and 10B, reversed.

As will be appreciated more clearly from the cross-sectional views of FIGS. 2 to 4, the movement of orientation of the moving elements 10A and 10B between the positions of opening and closing is obtained about the shafts 15 under the control of a mechanism with oscillating arm, which is identical for both of the moving elements 10A and 10B, and comprises:

a rotary actuator 30, which is to be controlled in rotation by the operator (directly by hand or using a tool) about an axis X30 parallel to the shafts 15;

an arm 32, which is drawn by the actuator 30 in a movement of slewing about the axis X30 and carries at its distal end a follower element 34 such as, for example, a follower roller; and a cavity 36 for sliding of the follower element 34, such as a rectilinear slit 36 (possibly open at one end) made in the body of the moving element 10A or 10B.

As will be appreciated more clearly from the comparison between FIGS. 2 and 4, the end positions of the aforesaid slewing movement (which has an amplitude of 90°) correspond to dead-centre conditions, in which the follower roller 34 is located at the end of the slit 36 more distant from the axis of the shaft 15 about which the moving element 10A turns. At the same time, the intermediate position of turning-over represented in FIG. 3 causes the follower roller 34 to advance towards the end of the slit 36 closer to the axis of the shaft 15 about which the moving element 10A turns.

In other words, the lever ratio of the mechanism (considered from the standpoint of the moving element) is most unfavourable at the two end positions (closing and opening).

Thanks to the mechanism described, in which at least one of the end positions—and preferably both of them—are dead-centre positions, the movement of opening and closing of the device 10 is convenient and "smooth" and, at the same time, the end positions (opening and closing) are in any case intrinsically stable, so that—for example—the operator does not run the risk of the moving element in the opening condition, on which he is applying the free end of the web, accidentally reclosing.

Equally advantageous, on the basis of the experiments conducted by the present applicant, is the intrinsic stability of the closing position, which, in combination with the shearing mechanism with which the blades 26 co-operate with the counterblade 140, renders altogether reliable and precise the operation of cutting of the trailing end of the old reel, in this way overcoming a deep-rooted prejudice against the possibility of doing without completely rigid and fixed structures for providing splicing devices of the type described herein.

A further degree of stability of the aforesaid positions of opening and/or closing can be achieved by setting between the moving elements 10A and 10B and the fixed frame of the device 10 spring-loaded pawls 38, which block the movement of orientation of the moving elements 10A and 10B and must be brought into a position of release by the operator in order to open and/or close the device.

Of course, without prejudice to the principle of the invention, the details of construction and the embodiments may vary widely with respect to what is described and illustrated herein, without thereby departing from the scope of the present invention, as defined by the annexed claims.

The invention claimed is:

1. A device for splicing the free end of a strip of web material to a homologous strip of web material being supplied, the device comprising:

a first moving element and a second moving element, each of which is able to function alternatively as retention structure for said free end and as guiding structure for said web of material being supplied, said first moving element and said second moving element being, at least in part, translatable with respect to one another for connecting said free end to said web of material being supplied; and wherein each of said first moving element and said second moving element is selectively orientable between:

a position of opening, in which one of the moving elements has a gripping formation for said free end exposed to receive said free end;

a position of closing, in which said gripping formation faces the other of the moving elements of the device for enabling a connection of said free end to said web being supplied; and wherein said first moving element and said second moving element carry associated thereto a mechanism of orientation between said position of opening and said position of closing, said mechanism comprising:

a rotary actuator, which can turn about an axis;

an arm, which can be driven by said actuator in a movement of slewing about said axis and carries at its distal end a follower element; and a cavity for sliding of said follower element, said cavity for sliding being fixed with respect to the respective moving element.

2. The device according to claim 1 further comprising selectively releasable clamping formations for clamping said moving elements in at least one position between said position of opening and said position of closing.

3. The device according to claim 2, wherein said clamping formations comprise spring-loaded pawls.

4. The device according to claim 1 wherein said gripping formation is a negative-pressure gripping formation.

5. The device according to claim 4, wherein said negative-pressure gripping formation is selectively activatable as a result of the orientation of the respective moving element towards said opening position.

6. The device according to claim 4 wherein said negative-pressure gripping formation is selectively deactivatable as a result of the orientation of the respective moving element towards said closing position.

7. The device according to claim 1 further comprising:

a supporting structure having a central plane; and said first moving element and said second moving element, located in positions specularly symmetrical with respect to said central plane.

8. The device according to claim 1 further comprising:

a supporting structure with a pair of shafts mounted on said supporting structure; and said first moving element and said second moving element, mounted so that they can turn about the one and the other of said shafts.

9. The device according to claim 1 wherein each of said first moving element and said second moving element is mounted on the device to allow orientation towards said opening position, in which said respective gripping formation faces upwards.

10. The device according to claim 1 wherein each of said first moving element and said second moving element is mounted on the device with the possibility of orientation towards said opening position, in which said respective gripping formation extends in the horizontal direction.

11. The device according to claim 1 wherein said first moving element and said second moving element carry respective blades, which can act on said web of material being supplied to cut it when said free end is connected to said web of material being supplied.

12. The device according to claim 11, further comprising a supporting structure carrying a counterblade, which is configured to co-operate with said blades when the respective moving element is in said closing position.

13. The device according to claim 12, wherein said blades have respective cutting edges extending at an angle with respect to said counterblade so that they co-operate with said counterblade according to a shearing mechanism.

* * * * *